US011124865B2

(12) United States Patent
Anderson et al.

(10) Patent No.: US 11,124,865 B2
(45) Date of Patent: Sep. 21, 2021

(54) CORROSION RESISTIVE MATERIALS, SYSTEMS, AND METHODS OF FORMING AND USING THE MATERIALS AND SYSTEMS

(71) Applicant: WISCONSIN ALUMNI RESEARCH FOUNDATION, Madison, WI (US)

(72) Inventors: Mark Anderson, Madison, WI (US); Anthony Schroeder, Madison, WI (US); Jacob Mahaffey, Madison, WI (US)

(73) Assignee: WISCONSIN ALUMNI RESEARCH FOUNDATION, Madison, WI (US)

( * ) Notice: Subject to any disclaimer, the term of this patent is extended or adjusted under 35 U.S.C. 154(b) by 291 days.

(21) Appl. No.: 16/114,611

(22) Filed: Aug. 28, 2018

(65) Prior Publication Data

US 2019/0062892 A1 Feb. 28, 2019

Related U.S. Application Data

(60) Provisional application No. 62/551,124, filed on Aug. 28, 2017.

(51) Int. Cl.
*C23C 8/16* (2006.01)
*F28F 19/06* (2006.01)
(Continued)

(52) U.S. Cl.
CPC ..... *C23C 8/16* (2013.01); *C23C 8/02* (2013.01); *F28D 9/0037* (2013.01); *F28F 19/06* (2013.01);
(Continued)

(58) Field of Classification Search
CPC . C23C 8/16; C23C 8/02; F28D 9/0037; F28F 19/06; F28F 21/083; F28F 21/085; F28F 21/087
See application file for complete search history.

(56) References Cited

U.S. PATENT DOCUMENTS 9,638,065 B2 * 5/2017 Vermeersch ..... F01K 13/02
2009/0294113 A1 12/2009 Cha et al.
(Continued)

OTHER PUBLICATIONS

Dyreby et al. ("Design considerations for supercritical carbon dioxide Brayton cycles with recompression." Journal of Engineering for Gas Turbines and Power 136.10 (2014).) (Year: 2014).*
(Continued)

*Primary Examiner* — Anthony J Zimmer
*Assistant Examiner* — Ricardo D Morales
(74) *Attorney, Agent, or Firm* — Seager, Tufte & Wickhem LLP

(57) ABSTRACT

A method to reduce corrosion rates of materials at high temperatures may include heating a mixture and applying the heated mixture to a material to be rendered thermodynamically noble. The mixture may include carbon monoxide and carbon dioxide and the material rendered thermodynamically noble may include copper or other material having similar physical properties. The copper or other similar material may be applied to a structural material and provide a surface interfacing with the mixture of carbon monoxide and carbon dioxide to prevent corrosion of the structural material. In some cases, the structural material may form a heat exchanger defining passageways for a working fluid of a power system and/or may form other passageways of the power system. The copper may be applied to the passageways as a protective coating and then made thermodynamically noble at high temperatures after interactions with the mixture of carbon monoxide and carbon dioxide.

14 Claims, 13 Drawing Sheets

(51) Int. Cl.
*F28F 21/08* (2006.01)
*C23C 8/02* (2006.01)
*F28D 9/00* (2006.01)

(52) U.S. Cl.
CPC ..... *F28F 21/083* (2013.01); *F28F 21/085* (2013.01); *F28F 21/087* (2013.01)

(56) References Cited

U.S. PATENT DOCUMENTS

2012/0128463 A1 5/2012 Held
2012/0159922 A1 6/2012 Gurin
2019/0256979 A1* 8/2019 Sandhage ..... C23C 18/1685

OTHER PUBLICATIONS

"Recommended Guidelines for the care of Power Boilers", The American Society of Mechanical Engineers, 2010.
Y. Wan, X. Wang, H. Sun, Y. Li, K. Zhang & Y. Wu. "Corrosion Behavior of Copper at Elevated Temperature." Int. J. Electrochem. Sci., 7 (2012) 7902-7914.
Rouillard, F., and T. Furukawa. "Corrosion of 9-12Cr Ferritic-martensitic Steels in High-temperature CO2." Corrosion Science 105 (2016): 120-32.
H. Magnusson and K. Frisk, "Self-diffusion and impurity diffusion of hydrogen, oxygen, sulphur and phosphorus in copper," Svensk Karnbranslehantering AB, Stockholm, 2013.
G. Musgrove, R. Pierres and J. Nash. "Heat Exchangers for Supercritical CO2 Power Cycle Applications." The 4th International Symposium for Supercritcal CO2 Power Cycles. Sep. 9 & 10, 2014.
V. Dostal, "A Supercritical Carbon Dioxide Cycle for Next Generation Nuclear Reactors," Massachusetts Institute of Technology, 2004.
Y. Kato, T. Nitawaki, and Y. Muto, "Medium Temperature Carbon Dioxide Gas Turbine Reactor," Nucl. Eng. Des., vol. 230, No. 1-3, pp. 195-207, 2004.
B. D. Iverson, T. M. Conboy, J. J. Pasch, and A. M. Kruizenga, "Supercritical CO2 Brayton Cycles for Solar-Thermal Energy," Appl. Energy, vol. 111, pp. 957-970, 2013.
B. A. Pint and J. R. Keiser, "The Effect of Temperature on the sCO2 Compatibility of Conventional Structural Alloys," in the 4th Supercritical CO2 Power Cycle Symposium, 2014.
I. G. Wright, B. A. Pint, J. P. Shingledecker, and D. Thimsen, "Materials Considerations for Supercritical CO2 Turbine Cycles," in ASME Turbo Expo 2013: Turbine Technical Conference and Exposition, 2013.
J. T. Mahaffey, "Effect of Partial Pressure of Oxygen and Activity of Carbon on the Corrosion of High Temperature Alloys in s-CO2 Environments," University of Wisconsin-Madison, 2017.
M. N. Arik, "Corrosion of Ferritic Steels in Supercritical CO2 at 450C," University of Wisconsin-Madison, 2017.
G. Cao, V. Firouzdor, K. Sridharan, M. Anderson, and T. R. Allen, "Corrosion of austenitic alloys in high temperature supercritical carbon dioxide," Corros. Sci., vol. 60, pp. 246-255, 2012.
V. Firouzdor, K. Sridharan, G. Cao, M. H. Anderson, and T. R. Allen, "Corrosion of a stainless steel and nickel-based alloys in high temperature supercritical carbon dioxide environment," Corros. Sci., vol. 69, pp. 281-291, 2013.
J. Mahaffey, D. Adam, A. Brittan, M. Anderson, and K. Sridharan, "Corrosion of Alloy Haynes 230 in High Temperature Supercritical Carbon Dioxide with Oxygen Impurity Additions," Oxid. Met., vol. 86, No. 5-6, pp. 567-580, 2016.
J. Mahaffey, D. Adam, M. Anderson, K. Sridharan, A. Brittan, M. N. Arik, and A. Schroeder, "Effect of Oxygen Impurity on Corrosion in Supercritical CO2 Environments," in the 5th International Supercritical CO2 Power Cycles Symposium, 2016.
A. Brittan, J. Mahaffey, M. Anderson, and K. Sridharan, "Mechanical and Corrosion Performance of the Weld of 740H and 282," in the 6th International Supercritical CO2 Power Cycles Symposium, 2018.
J. T. Mahaffey, A. Schroeder, D. Adam, A. Brittan, M. H. Anderson, A. Couet, and K. Sridharan, "Effects of CO and O2 Impurities on Supercritical CO2 Corrosion of Alloy 625," Metall. Mater. Trans. A, pp. 1-12, 2018.
L. Tan, M. H. Anderson, D. Taylor, and T. R. Allen, "Corrosion of austenitic and ferritic-martensitic steels exposed to supercritical carbon dioxide," Corros. Sci., vol. 53, No. 10, pp. 3273-3280, 2011.
Y. Gong, D. J. Young, P. Kontis, Y. L. Chiu, H. Larsson, A. Shin, J. M. Pearson, M. P. Moody, and R. C. Reed, "Acta Materialia on the breakaway oxidation of Fe9Cr1Mo steel in high pressure CO2," Acta Mater., vol. 130, pp. 361-374, 2017.
B. A. Pint, "The Effect of Impurities on Oxidation in CO2 at 750° C.," in Supercritical CO2 Power Cycles Symposium, 2018, No. March.
J. R. Davis, Ed., ASM Specialty Handbook: Heat-Resistant Materials. ASM International, 1997.
R. D. Holmes, H. S. C. O'Neill, and R. J. Arculus, "Standard Gibbs free energy of formation for Cu2O, NiO, CoO, and FexO: High resolution electrochemical measurements using zirconia solid electrolytes from 900-1400 K," Geochim. Cosmochim. Acta, vol. 50, No. 11, pp. 2439-2452, 1986.
D. J. Young, High Temperature Oxidation and Corrosion of Metals, 1st ed. Elsevier, 2008.
A. Cohen, "Corrosion of Copper and Copper Alloys," in Corrosion: Materials, vol. 13B, ASM Handbook, 13B ed., ASM International, 2005, pp. 125-163.
J. Mahaffey, A. Kalra, M. Anderson, and K. Sridharan, "Materials corrosion in high temperature supercritical carbon dioxide," in 4th International Symposium-Supercritical CO2 Power Cycles, 2014.
"Standard Test Methods for Tension Testing of Metallic Materials E8/E8M," vol. a. ASTM International, West Conshohocken, PA, 2013.
L. M. Weisenberger and B. J. Durkin, "Copper Plating," in Surface Engineering, vol. 5, ASM Handbook, ASM International, 1994, pp. 167-176.
V. Magula, J. Liao, K. Ikeuchi, T. Kuroda, Y. Kikuchi, and F. Matsuda, "New Aspects of Sensitization Behavior in Recent 316 Type Austenitic Stainless Steels," Trans. JWRI, vol. 25, No. 1, pp. 49-58, 1996.
D. M. E. Villanueva, F. C. P. Junior, R. L. Plaut, and A. F. Padilha, "Comparative study on sigma phase precipitation of three types of stainless steels□: austenitic , superferritic and duplex," Mater. Sci. Technol., vol. 22, No. 9, pp. 1098-1104, 2006.
C. Hsieh and W. Wu, "Overview of Intermetallic Sigma (σ) Phase Precipitation in Stainless Steels," ISRN Metall., vol. 2012, No. 4, pp. 1-16, 2012.
B. Weiss and R. Stickler, "Phase Instabilities During High Temperature Exposure of 316 Austenitic Stainless Steel," Metall. Trans., vol. 3, No. April, pp. 851-866, 1972.
Code Cases: Boilers and Pressure Vessels: Supplement 1. New York: ASME International, 2017.
Code Cases: Boilers and Pressure Vessels. New York: ASME International, 2007.
J. J. Jelinek, K. Sridharan, M. Anderson, T. R. Allen, G. Cao, and V. Firouzdor, "Corrosion Behavior of Alloys in High Temperature Supercritical Carbon Dioxide," in Corrosion 2012, 2012.
Code Cases: Boilers and Pressure Vessels: Supplement 1. New York: ASME International, 2007.

* cited by examiner

50

| | | 56 UTS (MPa) | 58 0.2% YS (MPa) | 60 Elongation (%) | |
|---|---|---|---|---|---|
| 62 | 316L: Unexposed | 605 ± 1 | 297 ± 3 | 81.2 ± 1.2 | 52 |
| 64 | 316L: 750°C $CO_2$ | 598 ± 15 | 220 ± 1 | 26.8 ± 4.7 | |
| 66 | 316L: 750°C $CO_2$ + 50ppm CO | 498 ± 14 | 291 ± 34 | 7.5 ± 1.7 | |
| 68 | 316L Cu: 750°C $CO_2$ | 590 ± 18 | 233 ± 12 | 29.1 ± 11.0 | |
| 70 | 316L Cu: 750°C $CO_2$ + 50ppm CO | 641 ± 4 | 263 ± 4 | 68.7 ± 4.2 | |
| 72 | 316L-316L: Unexposed | 541 ± 5 | 278 ± 2 | 41.2 ± 0.8 | 54 |
| 74 | 316L-316L: 750°C $CO_2$ | 586 ± 11 | 240 ± 13 | 19.2 ± 0.4 | |
| 76 | 316L-316L: 750°C $CO_2$ + 50ppm CO | 538 ± 2 | 252 ± 1 | 14.3 ± 0.5 | |
| 78 | 316L-316L Cu: 750°C $CO_2$ | 581 ± 21 | 237 ± 6 | 21.9 ± 5.4 | |
| 80 | 316L-316L Cu: 750°C $CO_2$ + 50ppm CO | 651 ± 15 | 256 ± 4.9 | 40.1 ± 4.3 | |

FIG. 9

CORROSION RESISTIVE MATERIALS, SYSTEMS, AND METHODS OF FORMING AND USING THE MATERIALS AND SYSTEMS

CROSS REFERENCE TO RELATED APPLICATIONS

This application claims the benefit of U.S. Provisional Patent Application Ser. No. 62/551,124, filed on Aug. 28, 2017, the disclosure of which is incorporated herein by reference.

STATEMENT REGARDING FEDERALLY SPONSORED RESEARCH OR DEVELOPMENT

This invention was made with government support under DE-EE0007117 awarded by the US Department of Energy. The government has certain rights in the invention.

TECHNICAL FIELD

The present disclosure pertains to systems and methods for producing corrosive resistant surfaces, and the like. More particularly, the present disclosure pertains to systems with corrosive resistant surfaces at high temperatures and/or pressures and methods of forming corrosive resistant surfaces at high temperatures and/or pressures.

PARTIES TO A JOINT RESEARCH AGREEMENT

The presently claimed invention was made by or on behalf of the below listed parties to a joint research agreement. The joint research agreement was in effect on or before the date the claimed invention was made, and the claimed invention was part of the joint research agreement and made as a result of activities undertaken within the scope of the joint research agreement. The parties to the joint research agreement are Purdue University; University of Wisconsin-Madison, and Georgia Tech Research Corporation.

37 C.F.R. § 1.104(C)(4)(II)(A) STATEMENT REGARDING JOINT RESEARCH AGREEMENT INVOKING EXCEPTION UNDER 35 U.S.C. § 102(B)(2)(C)

The disclosure of the subject matter on which the 35 U.S.C. § 102(a)(2) rejection in the Non-Final Office Action mailed Nov. 16, 2020, is based and the claimed invention were made by or on behalf of parties to a joint research agreement under 35 U.S.C. § 102(c). The joint research agreement as in effect on or before the effective filing date of the claimed invention. The claimed invention was made as a result of activities undertaken within the scope of the joint research agreement.

BACKGROUND

A variety of approaches and systems have been developed for producing materials that are resistant to corrosion. Such approaches may include utilizing materials having surfaces exposed to corrosive materials in a system that are naturally resistant to corrosion under operating conditions of the system. Of the known approaches for producing systems with materials that are resistant to corrosion, each has certain advantages and disadvantages.

SUMMARY

This disclosure is directed to several alternative designs for, devices for, and methods of creating thermodynamically noble materials at high temperatures. Although it is noted that noble materials are known, there exists a need for improvement on those noble materials.

Accordingly, one illustrative instance of the disclosure may include a method of rendering a material thermodynamically noble. The method may include heating a mixture of carbon monoxide and carbon dioxide and applying the heated mixture of carbon monoxide and carbon dioxide to a material to render the material thermodynamically noble. In some cases, the mixture of carbon monoxide and carbon dioxide may be heated to a temperature at or above three hundred (300) degrees Celsius.

Another illustrative instance of the disclosure may include a heat exchanger having a passageway defined at least in part by a plate formed from a first material. The first material may be coated with a copper coating such that the passageway is at least partially coated with the copper coating. The heat exchanger may be configured to receive fluid in the passageway, where the fluid is at or above a temperature of about three hundred (300) degrees Celsius.

Another illustrative instance of the disclosure may include a method of operating a power system. The method may include heating a working fluid of the power system and imparting nobility to a copper material of a passageway of the power system by passing the heated working fluid through the passageway. The working fluid may be a mixture of carbon dioxide and carbon monoxide. The mixture may have a carbon monoxide content of at least ten (10) parts per million of carbon dioxide.

The above summary of some example embodiments is not intended to describe each disclosed embodiment or every implementation of the disclosure.

BRIEF DESCRIPTION OF THE DRAWINGS

The disclosure may be more completely understood in consideration of the following detailed description of various embodiments in connection with the accompanying drawings, in which:

FIG. 9 depicts a chart of results of tensile tests applied to different samples of materials at room temperature;

Figure 1:
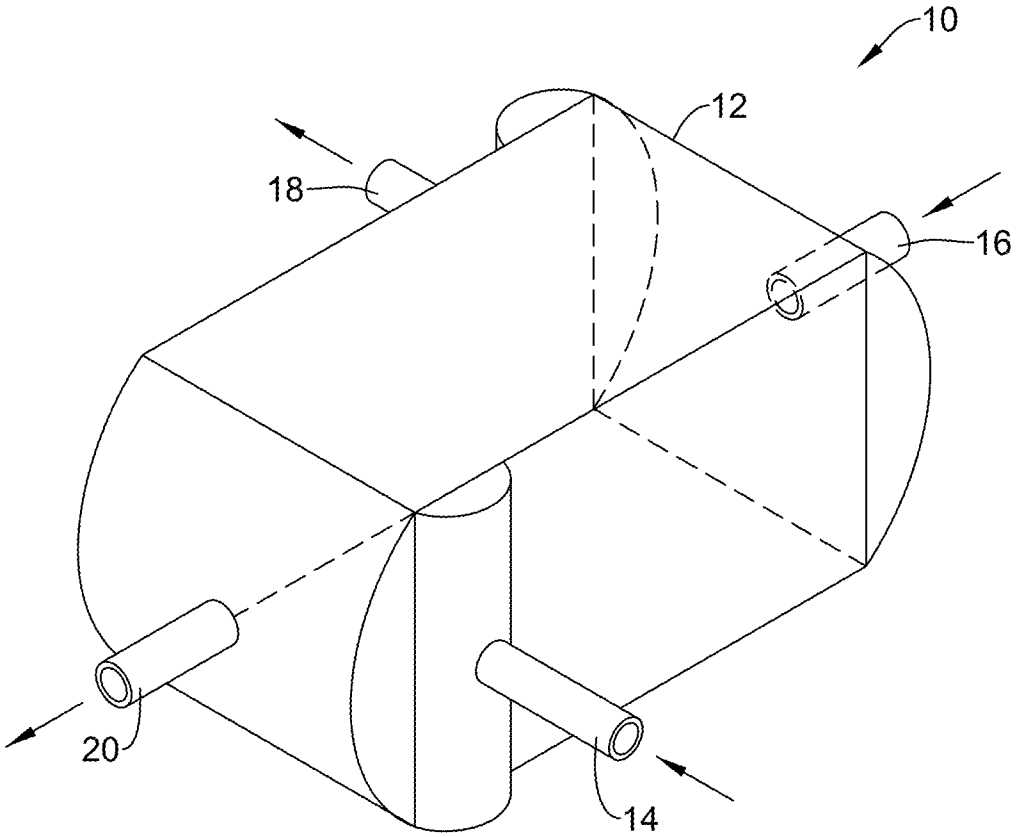
FIG. 1 is a schematic perspective view of an illustrative heat exchanger.

While the disclosure is amenable to various modifications and alternative forms, specifics thereof have been shown by way of example in the drawings and will be described in detail. It should be understood, however, that the intention is not to limit aspects of the claimed disclosure to the particular embodiments described. On the contrary, the intention is to cover all modifications, equivalents, and alternatives falling within the spirit and scope of the claimed disclosure.

DESCRIPTION

For the following defined terms, these definitions shall be applied, unless a different definition is given in the claims or elsewhere in this specification.

All numeric values are herein assumed to be modified by the term "about", whether or not explicitly indicated. The term "about" generally refers to a range of numbers that one of skill in the art would consider equivalent to the recited value (i.e., having the same function or result). In many instances, the term "about" may be indicative as including numbers that are rounded to the nearest significant figure.

The recitation of numerical ranges by endpoints includes all numbers within that range (e.g., 1 to 5 includes 1, 1.5, 2, 2.75, 3, 3.80, 4, and 5).

Although some suitable dimensions, ranges and/or values pertaining to various components, features and/or specifications are disclosed, one of skill in the art, incited by the present disclosure, would understand desired dimensions, ranges and/or values may deviate from those expressly disclosed.

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

As used in this specification and the appended claims, terms such as first, second, third, and so on, along with top, bottom, side, left, right, above, below, and/or other similar relative terms and are used herein for descriptive purposes unless the content clearly dictates otherwise.

The following detailed description should be read with reference to the drawings in which similar elements in different drawings are numbered the same. The detailed description and the drawings, which are not necessarily to scale, depict illustrative embodiments and are not intended to limit the scope of the claimed disclosure. The illustrative embodiments depicted are intended only as exemplary. Selected features of any illustrative embodiment may be incorporated into an additional embodiment unless clearly stated to the contrary.

Various devices and systems have materials that come into contact with corrosive materials and under certain operating conditions these materials may deteriorate after exposure to the corrosive materials, particularly at high temperatures and/or high pressures. In one example, a heat exchanger or other component in a power system (e.g., pipes, coils, tubes, valves, pumps, turbines, compressors, and/or one or more other components of a power generation system or other power system) may have one or more passageways that interact with a working fluid (e.g., a gas, liquid, or other material without a fixed shape) at high temperatures (e.g., temperatures above about three hundred (300) degrees Celsius) and/or high pressures (e.g., pressures between about 7.5 Megapascal (MPa) and 20 MPa and above) during operation of the power system, where the working fluid may be considered corrosive at operating conditions of the power system and may cause the material forming a surface of the passageway to corrode (e.g., due to oxidation) and/or carburize over time. Additionally or alternatively, other systems and/or components of other systems including, but not limited to, sequestration of $CO_2$ systems, $CO_2$ piping systems, $CO_2$ pumping systems, $CO_2$ storage systems, etc. may interact with corrosive fluids at high or low temperatures and/or at high or low pressures and the corrosive fluids may cause material forming a surface of the system or component of the system to corrode and/or carburize over time.

Power systems may have operating conditions with temperatures between three hundred (300) degrees Celsius and nine hundred (900) degrees Celsius or higher. Illustrative next generation power systems may include nuclear reactors power systems, coal power systems (e.g., third generation coal power systems and/or other coal power systems), concentrated solar power (CSP) systems, and/or other suitable types of power systems. The Brayton cycle, which may utilize supercritical $CO_2$ ($sCO_2$) (e.g., $CO_2$ at temperatures above the critical point of $CO_2$ (e.g., three hundred (300) degrees Celsius)) as a heat transfer fluid, has been identified as a thermodynamic cycle that may be utilized with next generation power systems due to its structural stability at high temperatures (e.g., temperatures above about three hundred (300) degrees Celsius) and high pressures (e.g., pressures between about 7.5 MPa and 20 MPa and above); example pressures of systems utilizing $sCO_2$ are discussed in Ahn, Yoonhan, et al. "Review of Supercritical $CO_2$ Power Cycle Technology and Current Status of Research and Development." *Nucl Eng Technol* 47 (2015): 647-661, which is hereby incorporated by reference in its entirety). Other thermodynamic cycles in addition to or as an alternative to the Brayton cycle may be utilized with next generation power systems. As the Brayton cycle and/or other thermodynamic cycles may utilize high temperatures and/or high pressures, one or more heat exchangers and/or other power system components that can withstand high temperatures and high pressures facilitate operation of power systems utilizing the Brayton cycle and/or other thermodynamic cycle.

Further, devices and systems having components with surfaces that contact corrosive materials at high temperatures and/or high pressures other than devices and components of power systems are contemplated. For example, devices and systems related to aircraft, space structures, and/or other devices, systems, or industries incorporating energy conversion systems may have components with surfaces that contact corrosive materials at high temperatures and/or high pressures.

A technique for protecting against corrosion and/or carburization of structural material (e.g., material maintaining a general form of a structure) in a system having operating conditions with high temperatures and/or high pressures may include providing a layer of non-corrosive material over the structural material and/or otherwise treating the structural material contacting the corrosive fluid such that the material (e.g., the structural material and/or the layer of non-corrosive material) is resistant to corrosion and/or carburization resulting from contact with the corrosive fluid and/or is resistant to degradation from high temperatures and/or high pressures resulting from the operating conditions of the system. In some cases, a layer of non-corrosive material may be a layer of non-structural material that receives its shape from an underlying structural material (e.g., a substrate), but it is contemplated that the layer of non-corrosive material may be a layer of structural material.

Although the disclosed concepts may be primarily described herein with respect to heat exchangers for power systems that operate at high temperatures and/or high pressures, the devices and techniques discussed herein may be used for and/or with other devices and/or components of devices. For example, the disclosed concepts may be applied to any passageway of a power system or other system that contacts corrosive fluid or other corrosive material including, but not limited to, passageways of valves, pumps, turbines, compressors, piping, coils, or tubing in a power system and/or other system.

Figure 2:
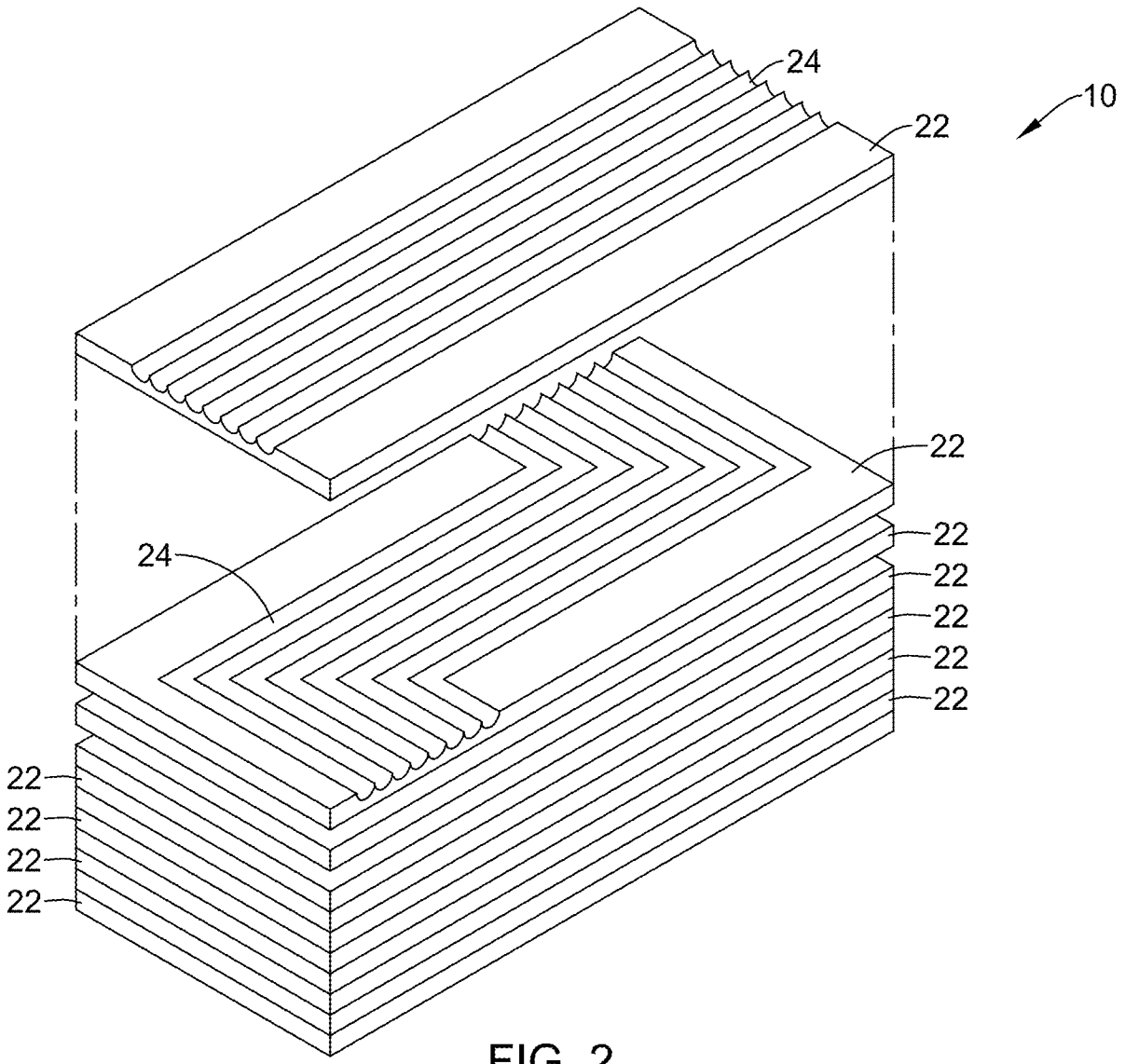
FIG. 2 is a schematic perspective view of illustrative plates of a heat exchanger.

Turning to the Figures, FIG. 1 depicts a schematic perspective view of a heat exchanger 10 (e.g., a printed circuit heat exchanger (PCHE) or other heat exchanger). The heat exchanger 10 may include an optional housing 12 receiving a plurality of plates (e.g., plates, as shown in FIG. 2), one or more inflow pipes (e.g., inflow pipes 14, 16), and one or more outflow pipes (e.g., outflow pipes 18, 20). In the heat exchanger 10, fluid (e.g., a working fluid) may enter through one or more of the inflow pipes 14, 16 and exit through one or more of the outflow pipes 18, 20. In some cases, the fluid may be pumped into and/or out of the heat exchanger with one or more pumps (not shown).

The fluid entering the heat exchanger 10 may be configured to perform a heat transfer as the fluid flows from the inflow pipes 14, 16 to the outflow pipes 18, 20 via channels in plates of the heat exchanger 10. In some cases, the fluid flowing into the heat exchanger 10 through one of the inflow pipes 14, 16 may be cooler than the fluid flowing into the heat exchanger 10 through the other of the inflow pipes 14, 16 to facilitate transferring heat between the respective fluids.

The fluid may be any type of fluid configured to transfer heat with another fluid through walls of a channel. In some cases, the fluid may be a supercritical carbon dioxide ($sCO_2$), steam (e.g., ultra-supercritical (USC) steam or other steam), a liquid (e.g., water, etc.), and/or one or more other suitable materials.

FIG. 2 depicts a schematic perspective view of a plurality of plates 22 (e.g., heat exchange members) of the heat exchanger 10 (e.g., where the housing 12 is removed from the heat exchanger 10). The plates 22 may be superimposed on one another and combined to facilitate forming the heat exchanger 10. Each plate 22 may include one or more channels 24 (only a single channel 24 is labeled in each plate for clarity purposes) that form passageways (e.g., passageways 26 depicted in FIG. 3) for fluid when adjacent plates 22 are abutting one another and/or attached to one another. Alternatively, or in addition, the channels 24 of the heat exchanger 10 may be formed from one or more structures other than the plates 22. For example, the channels 24 may be formed via a molding technique, three-dimensional printing, and/or other suitable techniques.

The plates 22, when included, may be connected to each other in one or more manners to form the heat exchanger 10. In some cases, the plates 22 may be bonded together. In one example, adjacent plates 22 may be brazed or diffusion bonded together to form passageways with the channels 24. Other connection techniques are contemplated.

The channels 24 of each plate 22 may take on a suitable configuration to form passageways that facilitate heat transfer between fluid in adjacent passageways. In some cases, the channels 24 may be curved, may be straight, may be angled, may zigzag, may take on one or more other shapes, and/or may be formed by bumps or formations in each plate 22. Curves and/or changes in direction of the channels 24 may result in increased heat transfer surface areas of the channels 24 and more efficient heat transfer when compared to straight channels 24 or channels 24 having fewer curves and/or turns.

As discussed above, the heat exchanger 10 may be utilized in power systems. For example, power systems utilizing the Rankine cycle, Brayton cycle, and/or other thermodynamic cycle may utilize heat exchangers. Additionally, heat exchangers may be utilized in other types of power systems, along with or as other types of types of devices and systems.

Heat exchangers and/or other components of systems may be formed from a structural material such as a stainless steel (e.g., ferritic stainless steel, 316 stainless steel, etc.) and/or other suitable material. However, stainless steel and/or other materials may oxidize and/or carburize when exposed to $sCO_2$, particularly at high temperatures (e.g., temperatures above about three hundred (300) degrees Celsius) and/or high pressures (e.g., pressures between about 7.5 MPa and 20 MPa and above). As such, a material that may be or may be made to be thermodynamically noble may be utilized for heat exchangers and/or other devices or components of systems in addition to or as an alternative to a stainless steel or other suitable structural material that may be reactive (e.g., may corrode and/or carburize) when in contact with $sCO_2$ or other fluid at high temperatures and/or high pressures. Example materials that may be or may be made to be thermodynamically noble at high temperatures and/or high pressures may include gold, silver, platinum, palladium, copper, nickel, molybdenum, chromium, titanium, zirconium, yttrium, and/or other noble materials. In some cases, alloys including the above thermodynamically noble materials may retain their thermodynamically noble properties.

In one example, copper may be utilized as a material of the heat exchanger 10 of a power system utilizing $sCO_2$ at high temperatures (e.g., temperatures above about three hundred (300) degrees Celsius). To maintain the structural integrity of the heat exchanger 10 and/or for other purposes, the heat exchanger 10 or other component may be formed from a first material (e.g., a structural material of stainless steel or other structural material (e.g., structural metals)) and may have passageways coated with a second material (e.g., a structural or non-structural layer of copper, copper alloys, silver, silver alloys, nickel, nickel alloys, and/or other material that has thermodynamically noble properties when interacting with $sCO_2$ at high temperatures) applied thereto. In such cases, the first material may be considered a substrate to which the second material is applied. When copper is utilized as the second material 28, the heat exchanger 10 may maintain its thermal property performance due, at least in part, to the copper having a higher thermal conductive than the first material of the substrate.

In addition to or as an alternative to applying the second material to the first material of the heat exchanger 10, the second material may be applied to a first material of one or more other components of power system utilizing $sCO_2$ or other working fluid at high temperatures (e.g., temperatures above about three hundred (300) degrees Celsius). In some cases, the second material may be applied to surfaces of piping, tubing, valves, and/or other components of the power system that may be in contact with $sCO_2$ during operation of the power system.

Figure 3:
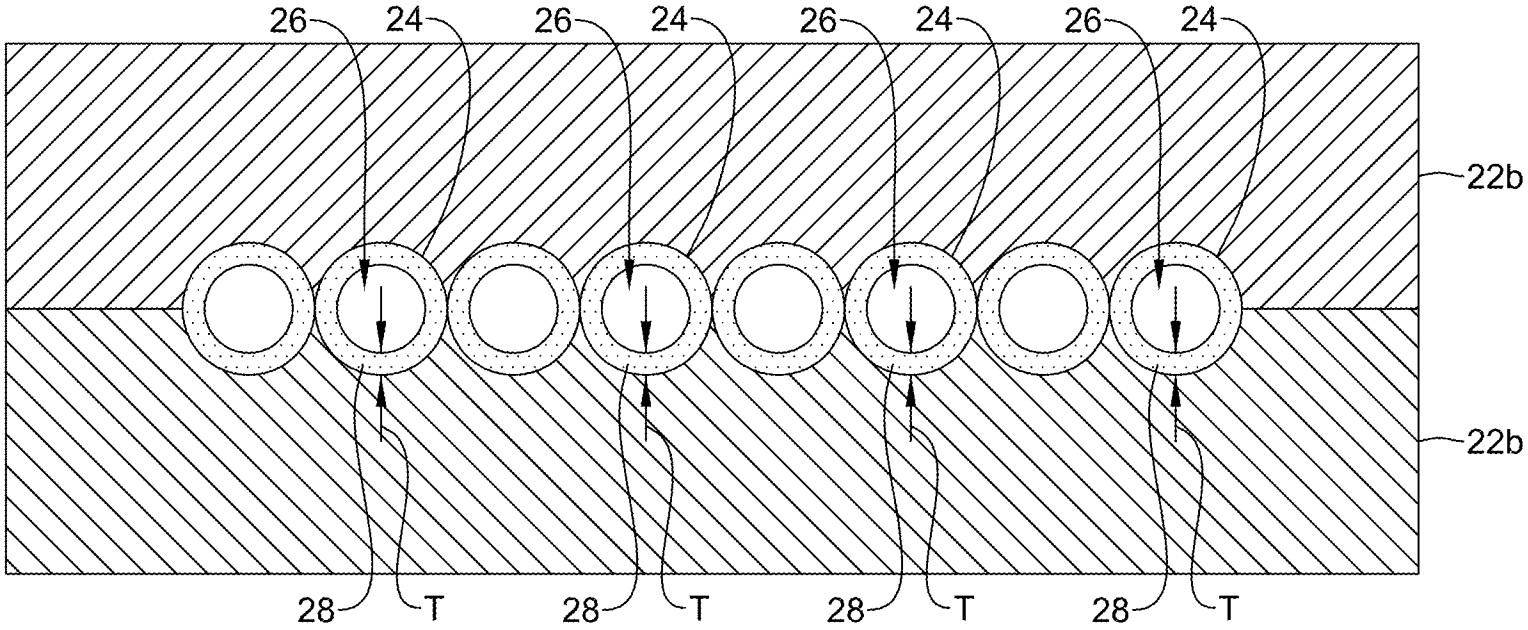
FIG. 3 is a schematic cross-sectional view of two adjacent plates of a heat exchanger.

FIG. 3 depicts an illustrative cross-section of a first plate 22*a* of a heat exchanger (e.g., heat exchanger 10) connected to a second plate 22*b* of the heat exchanger. Each of the connected plates 22*a*, 22*b* may include channels 24 that face a channel 24 of the other plate 22*a*, 22*b* to form passageways 26 (not all channels 24 and passageways 26 are labeled due to clarity purposes). Alternatively or in addition, the passageways 26 may be formed by a channel 24 in only one of the first plate 22*a* and the second plate 22*b*. Further, similar to as discussed above, although the first material generally forming or defining the passageways 26 is depicted and discussed with respect to the heat exchanger, the first material and passageways may be part of, or may be, other components (e.g., piping, tubing, valves, etc.) of a power system or other system.

Although the passageways 26 are depicted as having a rounded cross-section, the passageways 26 may take on a cross-section that has one or more other full or partial shapes including, but not limited to, a full or partial square, a full or partial rectangle, a full or partial star, and/or one or more other suitable shapes. Additionally or alternatively, the shape and/or sizes of a cross-section of a passageway 26 may be the same or different than the shape and/or size of cross-sections of one or more adjacent passageways 26. Further, the shape and/or size of a cross-section of a passageway 26 may be consistent along a length of the passageway 26 or the shape and/or size of a cross-section of a passageway 26 may vary along the length of the passageway 26.

As shown in FIG. 3, the passageway 26 may include a second material 28 (not labeled in each passageway 26 for clarity purposes) applied thereto, such that the second material 28 is configured to contact the $sCO_2$ or other fluid rather than the first material generally forming or defining the passageway 26. As discussed above, in some cases the second material may be copper or other material that may be thermodynamically noble at high temperatures and/or high pressures.

The second material may have a thickness T when applied to the first material. The thickness T of the second material may be selected based, at least in part on, a thickness needed to prevent carburization and/or oxidation of the first material when in an environment in which first material coated with the second material is expected to be used and/or the thickness T may be selected based, at least in part, on one or more other suitable factors. In some cases, the second material 28 as applied to the surface of the first material may have a thickness T of less than about ten (10) microns, between about 0.5 microns and about one thousand (1000) microns, and/or one or more other suitable thicknesses. In one example, the thickness T of the second material 28 applied to the surface of the first material may be at least fifty (fifty) microns. In further examples, the thickness T of the second material 28 applied to the surface of the first material may be between about thirty (30) microns and about one hundred fifty (150) microns and/or between about one hundred (100) microns and about three hundred (300) microns. Other ranges for thicknesses T of the second material 28 applied to the surface of the first material are contemplated.

Various methods for applying the second material 28 to the surface of the first material forming the passageway 26 may be utilized. In some cases, the second material 28 may be electroplated to the surface of the first material with electrodeposition techniques (e.g., using a sulfate-acid bath, a cyanide bath, and/or other bath). For example, when the second material 28 may be a copper material, a copper sulfate solution may be provided through the passageways 26 and a voltage applied to the heat exchanger 10 may be adjusted as the copper sulfate solution flows through the passageways 26 to achieve a uniform coating (e.g., thickness T) of the second material 28 or other thickness T of the second material 28 on the first material defining the passageways 26. Alternatively or in addition to applying the second material 28 to the surface of the first material with electrodeposition techniques, the second material 28 may be applied to the surface of the first material with a thermal spray technique, a diffusion bond technique, and/or other suitable techniques.

Once the second material 28 has been applied to the first material defining the passageways 26, the second material 28 may be rendered noble (e.g., thermodynamically noble at expected operating conditions of the heat exchanger) through one or more techniques. It may be necessary to impart thermodynamic nobility to render the second material 28 thermodynamically noble at high temperatures (e.g., temperatures above about three hundred (300) degrees Celsius) even when the second material 28 may exhibit noble properties at room temperature. For example, copper, which exhibits noble properties at room temperature, has low strength and poor steam-corrosion performance at high temperatures, and thus, imparting thermodynamic nobility to copper at high temperatures (e.g., when copper is used as the second material 28) allows the copper to perform unexpectedly well at high temperatures and/or high pressures (e.g., copper may be configured to stay structurally intact at high temperatures and/or high pressures).

Figure 4:
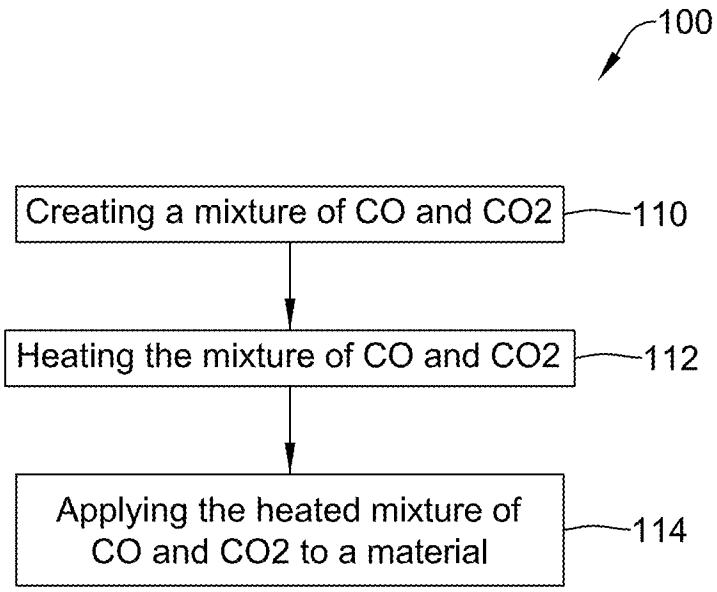
FIG. 4 is a schematic flow diagram depicting an illustrative method of rendering a material thermodynamically noble.

FIG. 4 depicts an illustrative schematic flow diagram of a technique 100 for rendering a material thermodynamically noble, particularly at high temperatures (e.g., temperatures above about three hundred (300) degrees Celsius, such as temperatures of an operating power system and/or other system). When the material to be rendered thermodynamically noble is copper or other material having similar physical properties, the technique 100 may include creating 110 a mixture of carbon monoxide (CO) and carbon dioxide ($CO_2$). The mixture of CO and $CO_2$ may then be heated 112 and the heated mixture may be applied 114 to the copper or other similar material. As discussed above, the material to be rendered noble at high temperatures may be applied to a substrate, such as steel (e.g., 316 stainless steel or other steel), but this is not required.

The mixture of CO and $CO_2$ may be heated to a suitable temperature. For example, the mixture of CO and $CO_2$ may be heated to a temperature at or above about three hundred (300) degrees Celsius, between about three hundred (300) degrees Celsius and about nine hundred (900) degrees Celsius, between about three hundred (300) degrees Celsius and about seven hundred fifty (750) degrees Celsius, between about five hundred (500) degrees Celsius and about nine hundred (900) degrees Celsius, and/or one or more other suitable temperatures. In some cases, a mixture of CO and $CO_2$ may occur or may be created during operation of a power system and the temperatures to which a mixture of CO and $CO_2$ may be heated in a power system are discussed in Ahn, Yoonhan et al. cited above and incorporated by reference.

In the method of FIG. 4, the mixture of CO and $CO_2$ may include a suitable amount of CO relative to $CO_2$ so as to render the copper or other similar material thermodynamically noble under certain pressure and/or temperature conditions. When rendering copper and other similar materials thermodynamically noble at high temperatures (e.g., temperatures above about three hundred (300) degrees Celsius), an example mixture of CO and $CO_2$ may have a wide range of allowable CO content relative to $CO_2$ content. For example, an illustrative mixture of CO and $CO_2$ having a content of CO in the mixture of at least ten (10) parts per million (ppm) may be capable of rendering copper thermodynamically noble at temperatures up to about seven hundred fifty (750) degrees Celsius. In some cases, an example mixture of CO and $CO_2$ may have a content of CO in the mixture of at least fifty (50) ppm, which may be capable of rendering copper thermodynamically noble at temperatures up to about nine hundred degrees Celsius. An amount of CO in the mixture of CO and $CO_2$ needed to render copper thermodynamically noble may be a function of (e.g., at least partially dependent on) temperature and/or pressure.

Figure 5:
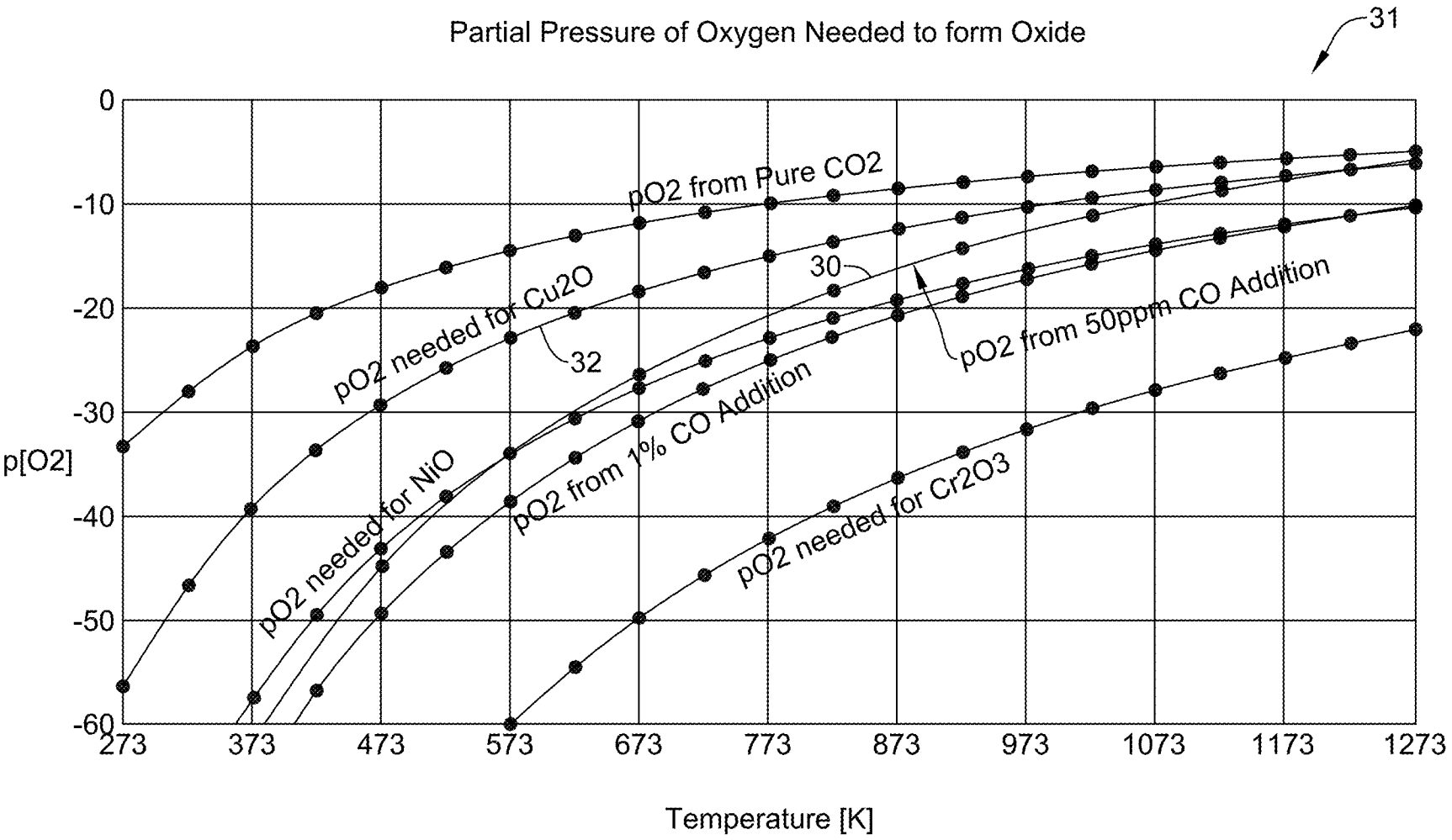
FIG. 5 is a graph depicting partial pressure of oxygen needed to form various oxides.

FIG. 5 depicts a graph 31 showing an amount of partial pressure of oxygen ($pO_2$) that is needed to form various oxides over a range of temperatures. As can be determined from the graph 31 of FIG. 5, because a $pO_2$ for a CO content of fifty (50) ppm in a mixture of $CO_2$ and CO (see line 30) is lower than the $pO_2$ needed to form copper oxide ($Cu_2O$) (see line 32) at all temperatures below one thousand one hundred seventy-three (1,173) Kelvin (about nine hundred (900) degrees Celsius), copper is thermodynamically noble at temperatures up to about nine hundred (900) degrees Celsius when in contact with a mixture of CO and $CO_2$ having a CO content of fifty (50) ppm because there is not enough oxygen present to form oxidation on or through the copper.

Figure 6B:
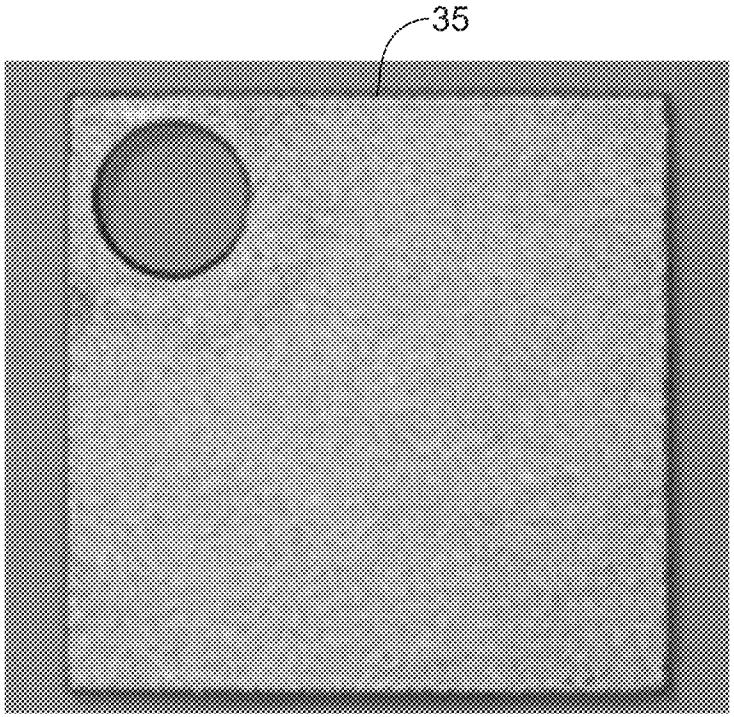
FIGS. 6A and 6B depict examples of exposing sample materials to a mixture of carbon monoxide and carbon dioxide at high temperatures.
Figure 6A:
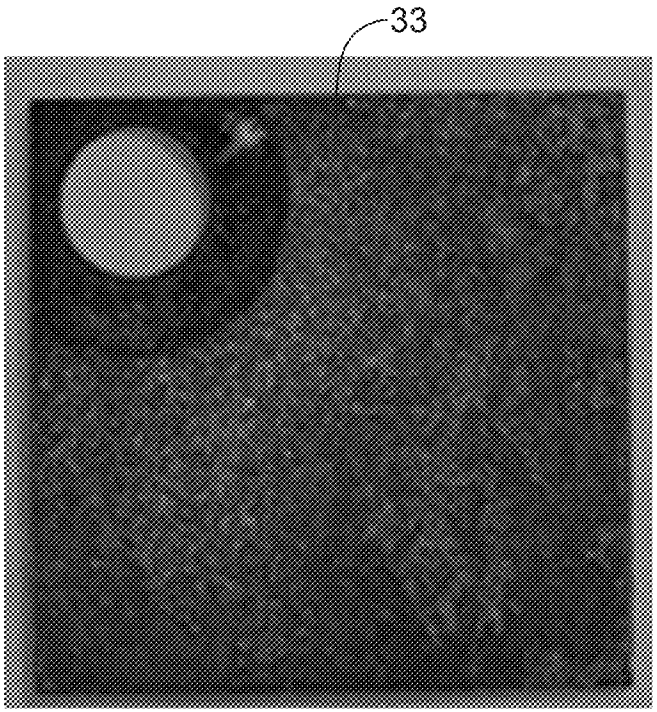

FIGS. 6A and 6B depict results of exposing sample materials to a mixture of CO and $CO_2$ at high temperatures and pressures that support the conclusion made from the graph of FIG. 5 that copper is thermodynamically noble when exposed to certain mixtures of CO and $CO_2$ at high temperatures and pressures. FIG. 6A depicts an uncoated piece 33 of 316 stainless steel that was exposed to a mixture of CO and $CO_2$ having a CO content of 50 ppm at a temperature of seven hundred fifty (750) degrees Celsius and a pressure of about twenty (20) MPa (about 2,900.75 psi). FIG. 6B depicts a coated piece 35 of 316 stainless steel with a thirty (30) micron thick coating of copper that was exposed to a mixture of CO and $CO_2$ having a CO content of 50 ppm at a temperature of seven hundred fifty (750) degrees Celsius and a pressure of 20 MPa. As can be seen, after exposure to the CO and $CO_2$ mixture, the uncoated piece 33 of 316 stainless steel in FIG. 6A has visible surface oxidation, while the copper coating of the copper coated piece 35 of 316 stainless steel in FIG. 6B is intact and there is no visible oxidation on the copper coating. These results support using a copper coating to protect against oxidation of an underlying material.

FIGS. 7A-7D depict optical images showing results of exposing coated and uncoated 316 stainless steel to a mixture of CO and $CO_2$ having a CO content of fifty (50) ppm at a temperature of seven hundred fifty (750) degrees Celsius and at a pressure of twenty (20) MPa. The results depicted in FIGS. 7A-7D demonstrate benefits of using a copper coating to protect against oxidation and carburization of an underlying material.

Figures 7A, 7B, 7C, 7D:
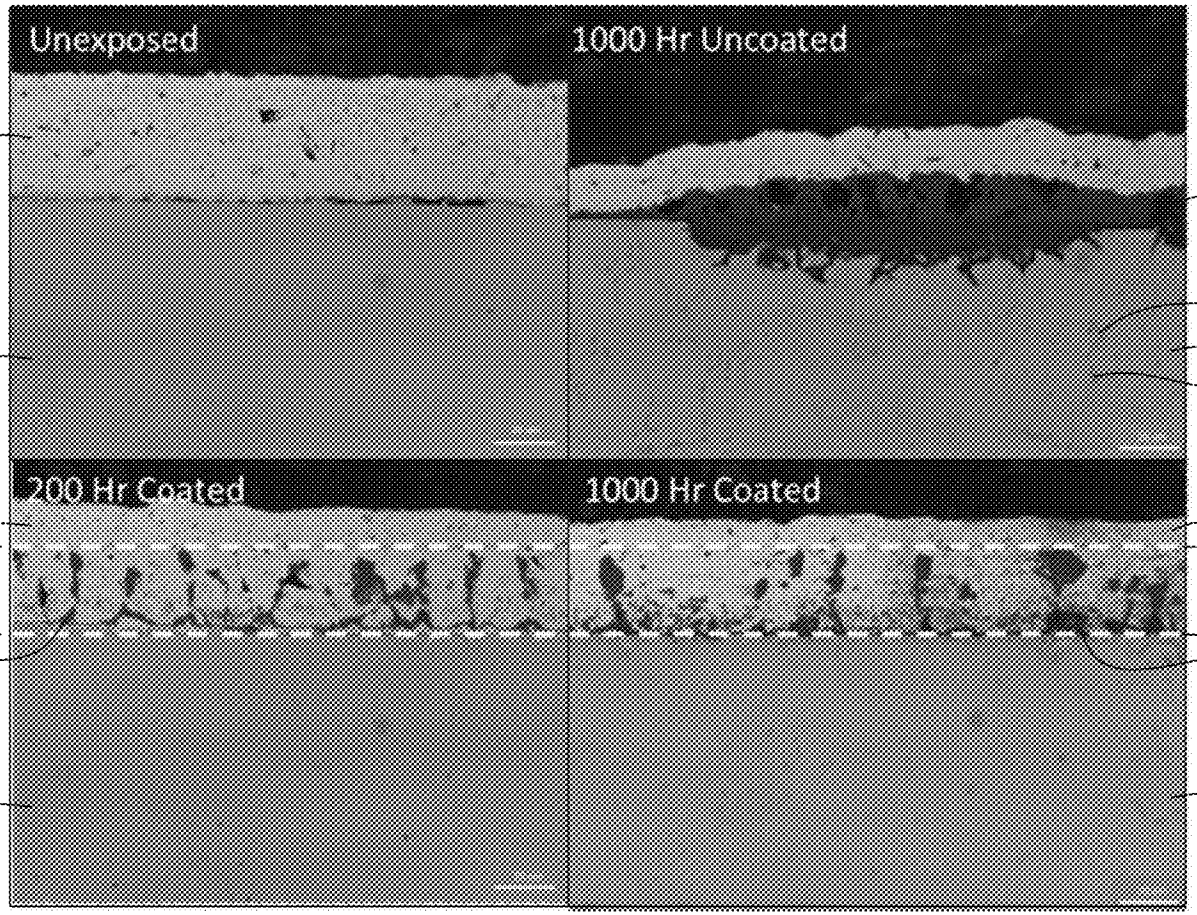
FIG. 7A depicts an optical image of a structural material exposed to a carbon monoxide and carbon dioxide mixture for 1000 hours.
FIG. 7B depicts an optical image of a structural material having a copper coating.
FIG. 7C depicts an optical image of the structural material having a copper coating of FIG. 7B after exposure to a carbon monoxide and carbon dioxide mixture for 200 hours.
FIG. 7D depicts an optical image of the structural material having a copper coating of FIG. 7B after exposure to a carbon monoxide and carbon dioxide mixture for 1000 hours.

FIG. 7A depicts an uncoated 316 stainless steel sample 34 that has been exposed to a $CO/CO_2$ mixture with a CO content of fifty (50) ppm at a temperature of seven hundred fifty (750) degrees Celsius and a pressure of twenty (20) MPa for one thousand (1000) hours. Note, although a coating appears to be applied to the 316 stainless steel sample 34 in FIG. 7A, the coating was not present during exposure of the 316 stainless steel sample 34 to the mixture, but was added after exposure to the mixture as part of an analysis procedure (e.g., to allow a surface of the 316 stainless steel sample 34 to be electrically conductive). FIG. 7B depicts a 316 stainless steel sample 34 coated with a copper coating 36 that has not been exposed to $CO/CO_2$ mixture. FIG. 7C depicts a 316 stainless steel sample 34 coated with the copper coating 36 that has been exposed to a $CO/CO_2$ mixture with a CO content of fifty (50) ppm at a temperature of seven hundred fifty (750) degrees Celsius and a pressure of twenty (20) MPa for two hundred (200) hours. FIG. 7D depicts a 316 stainless steel sample 34 coated with the copper coating 36 that has been exposed to a $CO/CO_2$ mixture with a CO content of fifty (50) ppm at a temperature of seven hundred fifty (750) degrees Celsius and a pressure of twenty (20) MPa for one thousand (1000) hours.

As can be seen when comparing the oxide height H (e.g., oxidation 38) in the copper coating 36 in FIGS. 7C and 7D (e.g., the vertical distance between the dashed lines in FIGS. 7C and 7D), the oxide height H appears to be effectively constant over time (e.g., from two hundred (200) hours to one thousand (1000) hours of exposure to the $CO/CO_2$ mixture). This indicates that a kinetic diffusion barrier generated by the copper coating is protective to the 316 stainless steel sample 34 and/or other structural material for extended periods of time. Moreover, this result may be beneficial as it is known in the art that uncoated 316 stainless steel shows time-dependent corrosion (e.g., oxidation) when exposed to mixtures of CO and $CO_2$. The difference in oxidation between an uncoated 316 stainless steel and a copper coated 316 stainless steel can be seen by comparing the image of FIG. 7A with the images of FIGS. 7C and 7D. For example, the oxidation 38 in the uncoated 316 stainless steel sample 34 of FIG. 7A is greater than in the 316 stainless steel sample 34 with copper coating 36 of FIGS. 7C and 7D, where there is essentially no oxidation of the 316 stainless steel sample 34.

In addition to protecting the 316 stainless steel sample 34 from oxidation, the copper coating 36 appears to result in a reduction and/or prevention of carburization of the stainless steel sample 34. Carburization may be a concern in $CO_2$ environments because carbon ingress at high temperatures (e.g., temperatures above about three hundred (300) degrees Celsius) may be deeper than oxidation, and unlike oxidation, carburization may have the tendency to embrittle 316 stainless steel sample 34 or other structural material. The embrittling of the 316 stainless steel sample 34 or other structural material may be due to the formation of metal carbides at grain boundaries which then lock the boundaries and prevent ductal slipping. In environments such as those to which heat exchangers may be exposed (e.g., environments with cyclic loading and/or other environments), a fatigue susceptibility imparted by carburization is a known problem within the industry and potential limiting factor for the use of numerous materials (e.g., including, but not limited to, stainless steels) with otherwise promising mechanical properties at high temperatures.

The protection from carburization by the copper coating 36 may occur, at least in part, due to the copper acting as an inhibitor of carbon transport. While oxygen transport through copper may be relatively fast (e.g., when compared to other metals), it forms no stable carbides and copper has no or almost no solubility for carbon. As such, it may be difficult for carbon to pass through the copper coating 36 and degrade the 316 stainless steel sample 34 or other structural material. This distinction can be seen by comparing the 316 stainless steel samples 34 in FIGS. 7A and 7D, where the uncoated 316 stainless steel sample 34 in FIG. 7A shows an internal attack throughout the material (e.g., carbide formation as represented by lines and markings 37 in the 316 stainless steel sample 34) while the 316 stainless steel sample 34 with a copper coating 36 in FIG. 7D appears to be in a similar condition to that of the 316 stainless steel samples 34 of FIGS. 7B and 7C.

Figure 8:
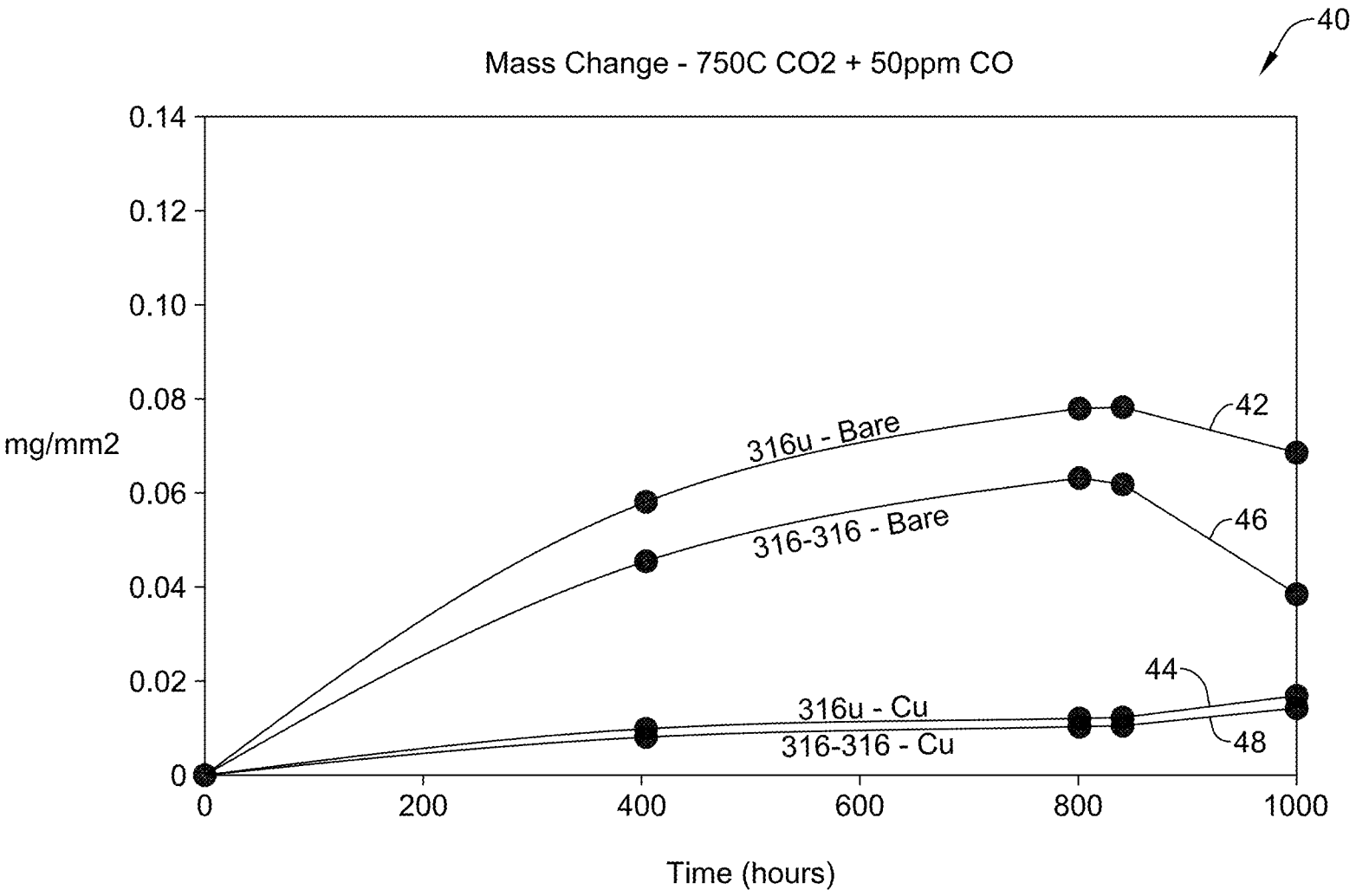
FIG. 8 depicts a graph of mass change of different samples of material during exposure to a carbon monoxide and carbon dioxide mixture during a period of one thousand (1000) hours.
Figure 10:
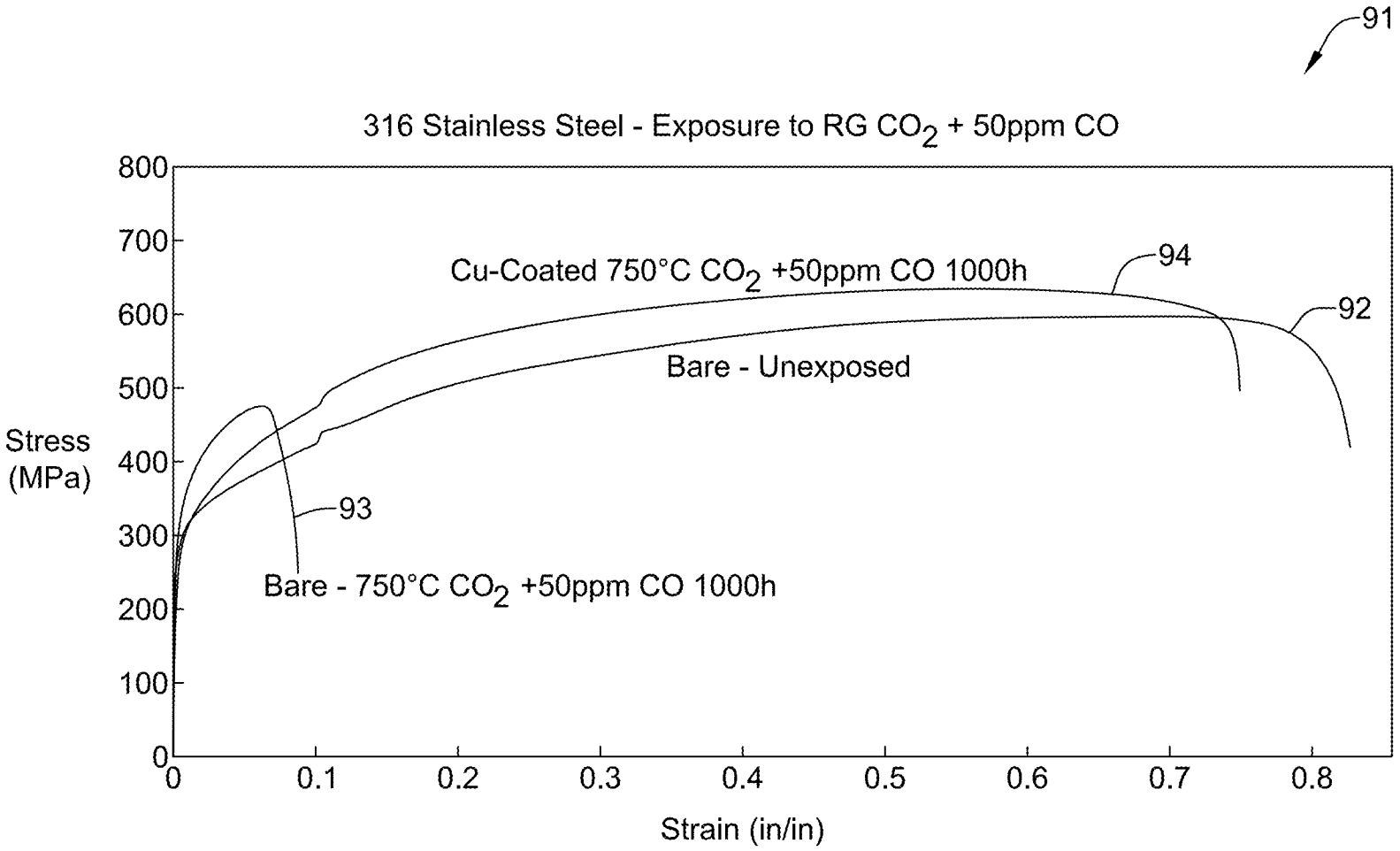
FIG. 10 depicts a graph showing stress/strain curves for different samples of materials.
Figure 11:
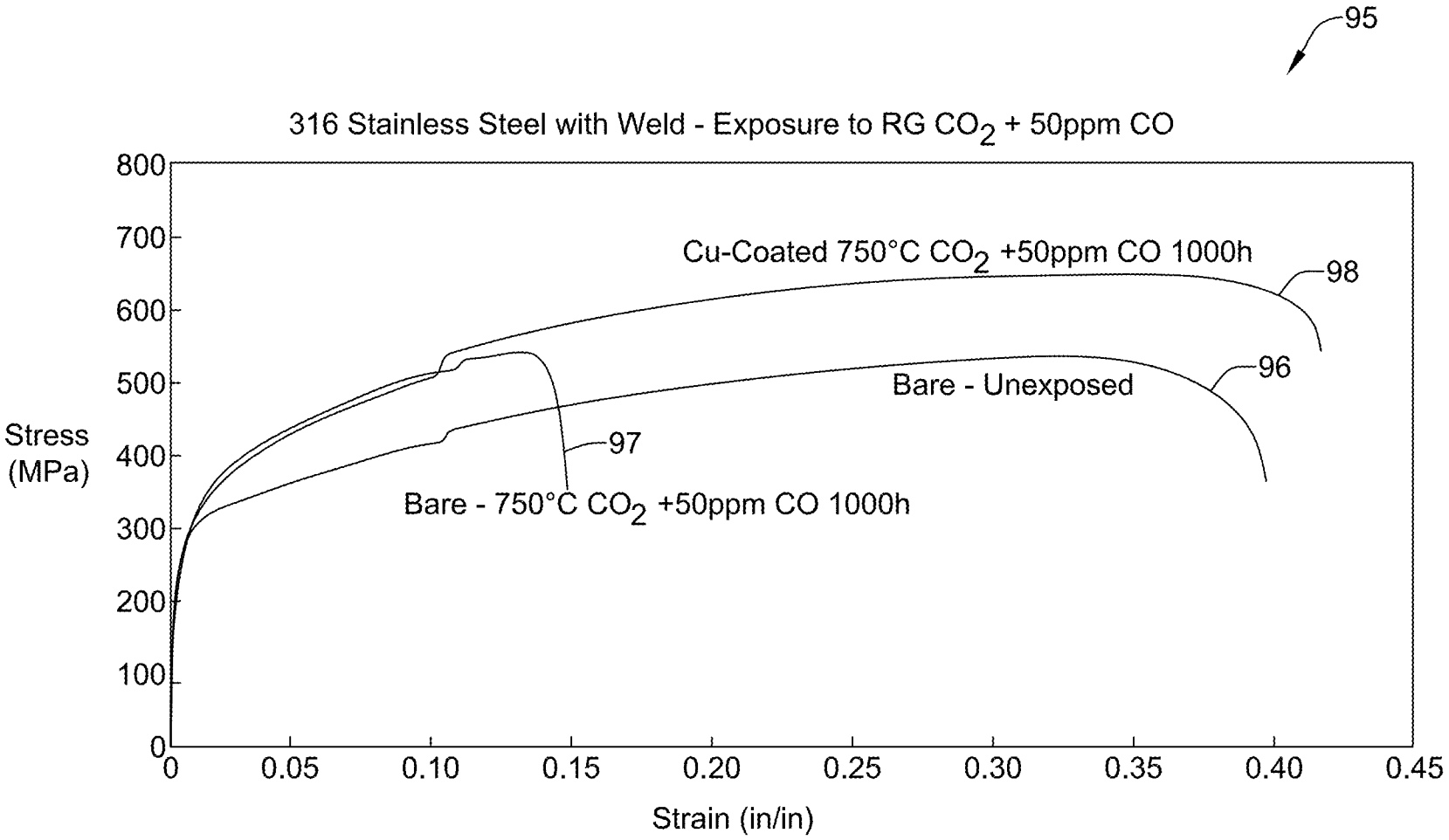
FIG. 11 depicts a graph showing stress/strain curves for different samples of materials that each include a weld joint.

FIGS. 8-11 depict additional evidence of the benefits of the coating an underlying structural material such as 316 stainless steel with copper or other similar material. FIG. 8 depicts a graph showing mass changes of samples of material, FIG. 9 depicts a chart showing results of tensile tests on samples of material, and FIGS. 10 and 11 depict graphs of stress/strain curves for samples of material.

FIG. 8 depicts a graph 40 of a mass change of samples over time when the samples are exposed to a $CO/CO_2$ mixture having 50 ppm CO over a one thousand (1,000) hour period, with the mixture at a pressure of twenty (20) MPa and heated to a temperature of 750 degrees Celsius. The x-axis depicts mass change of the samples in $mg/mm^2$ and the y-axis depicts exposure time of the samples to the mixture in hours. In the graph 40, line 42 represents a mass change of a 316 stainless steel sample that does not include a copper coating, line 44 represents a mass change of a 316 stainless steel sample that includes a copper coating, line 46 represents a mass change of two 316 stainless steel samples welded together that does not include a copper coating, and line 48 represents a mass change of two 316 stainless steel samples welded together that includes a copper coating. As can be seen from the graph 40, the samples without the copper coating (e.g., as represented by lines 42 and 46) had a large increase in mass when compared to the mass increase of the samples with the copper coating (e.g., as represented by lines 44 and 48) over the sample exposure time of one thousand (1000) hours. From the results of this testing as depicted in the graph 40, it is apparent that the copper coating has eliminated a large amount of corrosion that 316 stainless steel otherwise experiences without the copper coating.

FIG. 9 depicts a chart 50 of the results of tensile tests on various samples of materials that were exposed to $CO_2$ or a $CO/CO_2$ mixture having fifty (50) ppm CO at 20 MPa and 750 degrees Celsius for one thousand (1,000) hours as compared to a sample of material that is not exposed to either one of such conditions ("operating conditions"). Section 52 of the chart 50 depicts results of samples of 316 stainless steel without a weld joint and section 54 of the chart 50 depicts results of samples with a weld joint between two pieces of 316 stainless steel. The benefits of a copper coating on welded pieces of 316 stainless steel was tested as weld joints are considered the weakest portion of a sample and may be prone to failure.

Column 56 depicts results of an ultimate tensile strength (UTS) test on the samples, column 58 depicts results of a yield strength (YS) test on the samples, and column 60 depicts the results of an elongation test on the samples. Row 62 depicts results for a 316 stainless steel sample without a copper coating that is not exposed to the operating conditions, row 64 depicts results for a 316 stainless steel sample without a copper coating that is exposed to $CO_2$ at 20 MPa and 750 degrees Celsius, row 66 depicts results for a 316 stainless steel sample without a copper coating that is exposed to a mixture of $CO/CO_2$ having fifty (50) ppm CO at 20 MPa and 750 degrees Celsius, row 68 depicts results for a 316 stainless steel sample with a copper coating that is exposed to $CO_2$ at 20 MPa and 750 degrees Celsius, and row 70 depicts results for a 316 stainless steel sample with a copper coating that is exposed to a mixture of $CO/CO_2$ having fifty (50) ppm CO at 20 MPa and 750 degrees Celsius. Row 72 depicts results for welded 316 stainless steel samples without a copper coating that is not exposed to the operating conditions, row 74 depicts results for welded 316 stainless steel samples without a copper coating that is exposed to $CO_2$ at 20 MPa and 750 degrees Celsius, row 76 depicts results for welded 316 stainless steel samples without a copper coating that is exposed to a mixture of $CO/CO_2$ having fifty (50) ppm CO at 20 MPa and 750 degrees Celsius, row 78 depicts results for welded 316 stainless steel samples with a copper coating that is exposed to $CO_2$ at 20 MPa and 750 degrees Celsius, and row 80 depicts results for welded 316 stainless steel samples with a copper coating that is exposed to a mixture of $CO/CO_2$ having fifty (50) ppm CO at 20 MPa and 750 degrees Celsius.

The results depicted in the chart 50 were obtained by applying tensile tests to the samples at room temperature and tend to indicate a large effect of a $CO_2$ environment on mechanical properties of 316 stainless steel. As can be seen in FIG. 9, a change in ductility of the samples, as measured by elongation, is the parameter most impacted by using a copper coating on the 316 stainless steel and the coated samples remained ductile. Even so, the results of the UTS test and the YS test improved for the coated samples (e.g., rows 68, 70, 78, and 80) relative to the uncoated samples (e.g., rows 64, 66, 74, 76).

FIGS. 10 and 11 depict stress/strain curves of samples of materials that were exposed to a $CO/CO_2$ mixture having fifty (50) ppm CO at 20 MPa and 750 degrees Celsius for one thousand (1,000) hours as compared to a sample of material that was not exposed to such conditions. In FIG. 10, Line 92 represents a sample of 316 stainless steel that did not include a copper coating and which was not exposed to the heated and pressurized $CO/CO_2$ mixture. Line 93 represents a sample of 316 stainless steel that did not include a copper coating and which was exposed to the heated and pressurized $CO/CO_2$ mixture. Line 94 represents a sample of 316 stainless steel that did include the copper coating and which was exposed to the heated and pressurized $CO/CO_2$ mixture. As can be seen see from the graph 94, the sample with the copper coating showed improved tensile performance over the sample without the copper coating (e.g., the sample with the copper coating had a much higher break or rupture point than the sample without copper coating) after exposure to the heated and pressurized mixture of $CO/CO_2$. As a result, the copper coating may be utilized as an effective carbon barrier for underlying material (e.g., structural material), such as 316 stainless steel.

Similar to the results depicted in the graph 91 of FIG. 10, the results depicted in graph 95 of FIG. 11 support the finding that a copper coating may be utilized as an effective carbon barrier for an underlying material (e.g., a structure material), such as 316 stainless steel, and may even be used to improve the performance of material at weld joints. In FIG. 11, line 96 represents welded samples of 316 stainless steel that did not include a copper coating and which was not exposed to the heated and pressurized $CO/CO_2$ mixture. Line 97 represents welded samples of 316 stainless steel that did not include a copper coating and which was exposed to the heated and pressurized $CO/CO_2$ mixture. Line 98 represents welded samples of 316 stainless steel that did include the copper coating and which was exposed to the heated and pressurized $CO/CO_2$ mixture. As can be seen from the graph 95, the welded samples with the copper coating showed improved tensile performance over welded samples without the copper coating (e.g., the welded samples with the copper coating had a much higher break or rupture point than the welded samples without copper coating) after exposure to the heated and pressurized mixture of $CO/CO_2$.

Figure 12:
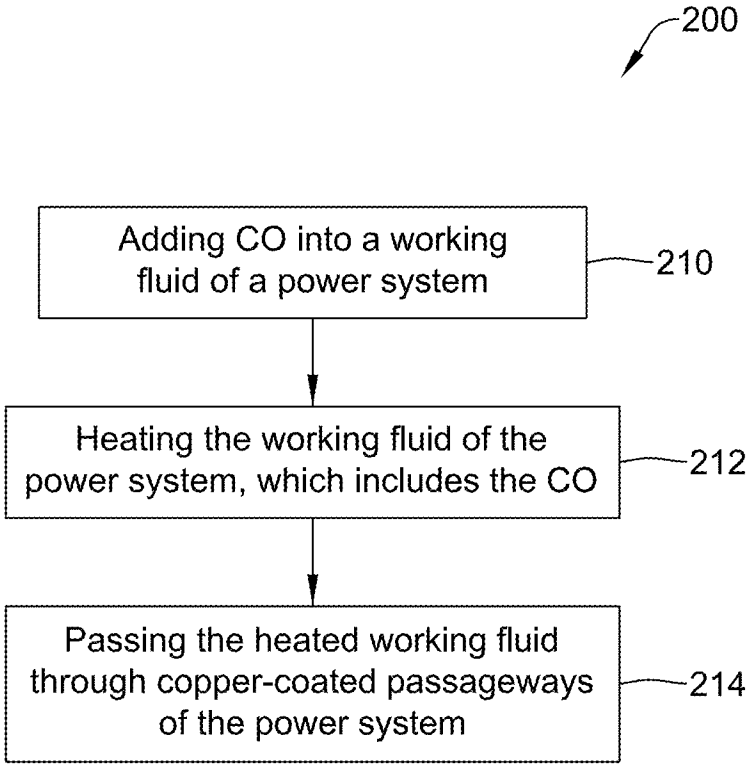
FIG. 12 is a schematic flow diagram depicting an illustrative method of operating a power system.

As discussed, copper may be applied to passageways of power systems and/or other systems that are configured to contact potentially corrosive materials at high temperatures (e.g., temperatures above about three hundred (300) degrees Celsius) to facilitate preventing corrosion and carburization of an underlying material. However, as copper is not naturally noble (e.g., non-reactive) at high temperatures, copper may be imparted with nobility through one or more processes, which may occur during or as part of operation of a power system or other system. FIG. 12 depicts a method 200 of operating a power system that may impart thermodynamic nobility on a copper material or other material in a passageway of a power system (e.g., a passageway of a heat exchanger, piping, or other passageway). Although the method 200 describes imparting thermodynamic nobility on a copper material, a similar method may be applied to impart thermodynamic nobility on materials having similar physical properties to those of copper and/or a similar method may be applied to impart thermodynamic nobility on materials in systems other than power systems.

In the method 200, an amount of carbon monoxide may be added 210 into a working fluid of a power systems to create a mixture. Although not required, the working fluid may be a carbon dioxide (e.g., a supercritical carbon dioxide) and the mixture may have a carbon monoxide content of at least ten (10) ppm. The mixture of the working fluid and the carbon monoxide may be heated 212. In some cases, the working fluid may already be heated when the carbon monoxide is added and may accordingly heat the mixture of the working fluid and the carbon monoxide. Alternatively, the carbon monoxide may be injected 210 into the working fluid and the mixture may then be heated. Further, the mixture of carbon monoxide and the working fluid may be heated to a suitable temperature. For example, the mixture of carbon monoxide and the working fluid may be heated to a temperature at or above about three hundred (300) degrees Celsius, between about three hundred (300) degrees Celsius and about nine hundred (900) degrees Celsius, between about three hundred (300) degrees Celsius and about seven hundred fifty (750) degrees Celsius, and/or one or more other suitable temperatures. The heated working fluid mixture with carbon monoxide may then be passed 314 through passageways of the power system or other system coated with copper or other materials to be made noble at high temperatures. Once the mixture of carbon monoxide and the working fluid has been applied to the copper or other material of the passageways, the copper or other material may be thermodynamically noble and protect an underlying structural material from corrosion.

The adding 210 of carbon monoxide to the working fluid may include initially injecting carbon monoxide into the working fluid at startup of the power system and/or utilizing carbon monoxide that may result as a byproduct of utilizing supercritical carbon dioxide as the working fluid in the power systems. As such, it may be possible to facilitate maintaining a carbon monoxide content in the mixture of carbon monoxide and carbon dioxide (e.g., the working fluid) at or above 10 ppm without injecting carbon monoxide into the working fluid after the initial injection of carbon monoxide.

Figure 13:
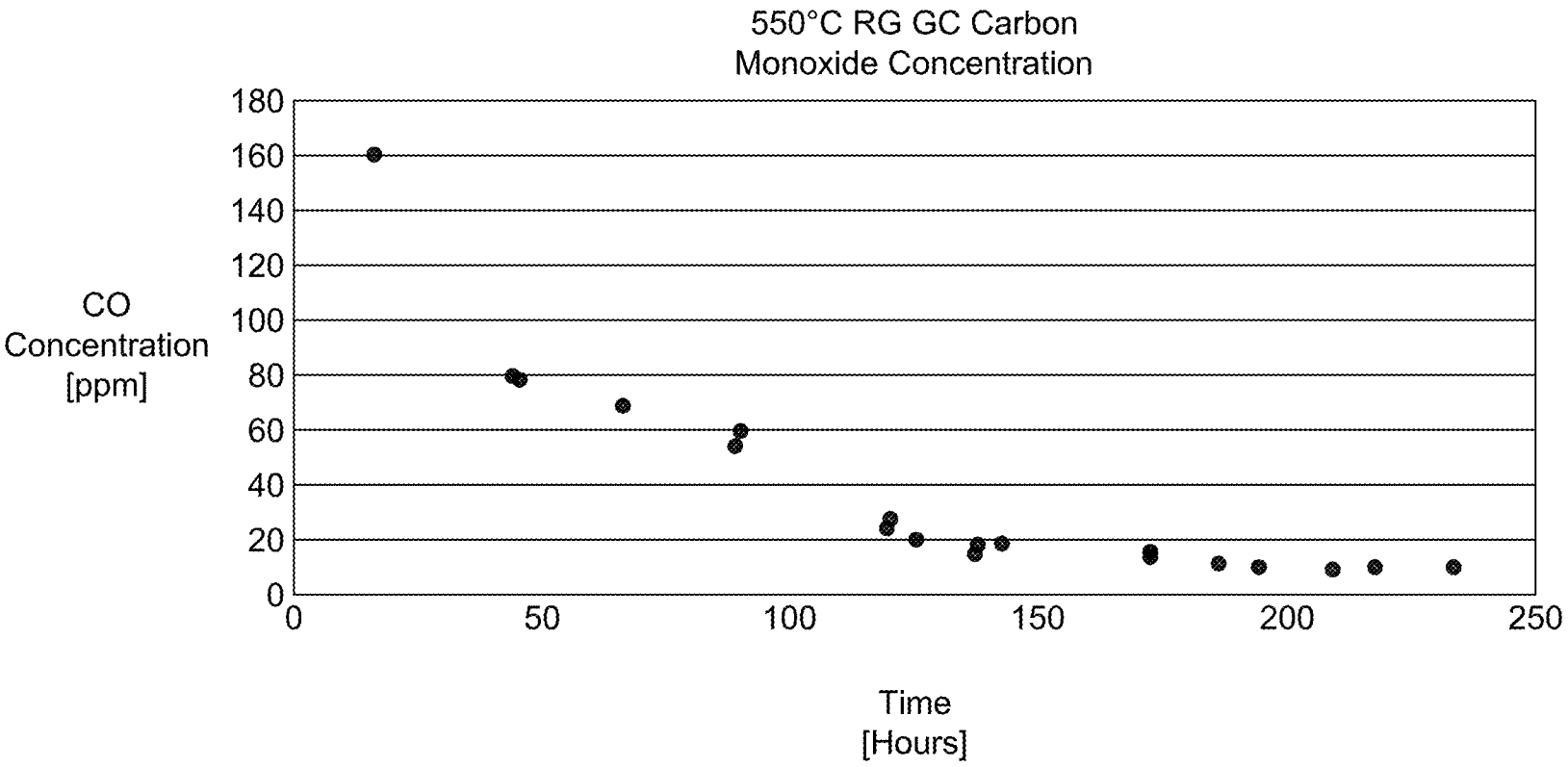
FIG. 13 is a chart depicting a generation of carbon monoxide concentration in a carbon dioxide working fluid of a power system over time.

FIG. 13 is a graph depicting CO content generated in a working fluid of pure supercritical $CO_2$ at a temperature of five hundred fifty degrees Celsius over an extended period of operating time. As can be seen from FIG. 13, a sufficient amount of CO (e.g., greater than (10) ppm CO) may be generated from the corrosion process of supercritical $CO_2$ at high temperatures or operating conditions of a power system such that the power system may be able to naturally maintain a requisite amount of CO in the working fluid mixture (e.g., a mixture of CO and $CO_2$) to continually render the copper coating or other coating of the passageways thermodynamically noble (e.g., the power system may self-maintain the copper in a non-reactive state).

Those skilled in the art will recognize that the present disclosure may be manifested in a variety of forms other than the specific embodiments described and contemplated herein. Accordingly, departure in form and detail may be made without departing from the scope and spirit of the present disclosure as described in the appended claims.

What is claimed is:

1. A method of rendering a material thermodynamically noble, the method comprising:

heating a mixture of carbon monoxide and carbon dioxide to a temperature above three hundred degrees Celsius; and applying the heated mixture of carbon monoxide and carbon dioxide to a coating of a heat exchanger or a power system to render the coating thermodynamically stable; and wherein the mixture comprises at least ten parts per million (ppm) of carbon monoxide.

2. The method of claim 1, wherein the mixture comprises at least fifty parts per million (ppm) of carbon monoxide.

3. The method of claim 1, wherein the mixture is heated to a temperature.

4. The method of claim 1, wherein the coating comprises material applied to a substrate prior to applying the heating mixture to the coating.

5. The method of claim 4, wherein the material applied to the substrate has a thickness of at least ten microns.

6. The method of claim 4, wherein the material applied to the substrate has a thickness between one hundred microns and three hundred microns.

7. The method of claim 1, wherein the coating comprises copper.

8. The method of claim 1, wherein the coating coats a passageway in the power system and the mixture is heated to the temperature above three hundred degrees Celsius during operation of the power system.

9. The method of claim 8, further comprising:

injecting carbon monoxide into the passageway of the power system prior to heating the mixture.

10. The method of claim 1, wherein the material is a coating of a passageway in a heat exchanger.

11. A method of operating a power system, the method comprising:

heating a working fluid of the power system;

imparting nobility to a copper material of a passageway of the power system by passing the heated working fluid through the passageway; and wherein the working fluid comprises a mixture of carbon dioxide and carbon monoxide having at least ten parts per million (ppm) of carbon monoxide.

12. The method of claim 11, further comprising:

adding carbon monoxide to the working fluid of the power system to initially form the mixture.

13. The method of claim 11, further comprising:

maintaining a carbon monoxide content in the mixture at or above ten parts per million (ppm) of carbon monoxide.

14. The method of claim 11, wherein heating the working fluid of the power system includes heating the working fluid to a temperature at or above three hundred degrees Celsius.

* * * * *